US005134955A

United States Patent [19]

Manfield

[11] Patent Number: 5,134,955

[45] Date of Patent: Aug. 4, 1992

[54] SUBMERGIBLE DIVING SLED

[76] Inventor: Harold D. Manfield, 4684 Ashton Rd., Sarasota, Fla. 34233

[21] Appl. No.: 714,327

[22] Filed: Jun. 11, 1991

Related U.S. Application Data

[63] Continuation of Ser. No. 410,287, Sep. 21, 1989, abandoned, which is a continuation-in-part of Ser. No. 238,583, Aug. 31, 1988, abandoned.

[51] Int. Cl.[5] ..... B63G 8/18

[52] U.S. Cl. ..... 114/332

[58] Field of Search ..... 114/315, 330, 331, 332, 114/242, 244, 245, 253

[56] References Cited

U.S. PATENT DOCUMENTS

| | | | |
|---|---|---|---|
| 2,843,860 | 7/1958 | Grootveld | 114/245 |
| 2,936,466 | 5/1960 | Szymczyk et al. | 441/65 |
| 3,065,722 | 11/1962 | Green | 114/245 |
| 3,082,731 | 3/1963 | Cousteau et al. | 114/244 |
| 3,084,654 | 4/1963 | Rosenberg et al. | 114/315 |
| 3,103,195 | 9/1963 | Cousteau et al. | 114/330 |
| 3,131,664 | 5/1964 | McInvale | 114/315 |
| 3,134,351 | 5/1964 | Ely, Jr. | 114/332 |
| 3,157,145 | 11/1964 | Farris et al. | 114/332 |
| 3,190,256 | 6/1965 | Buie | 114/315 |
| 3,204,596 | 9/1965 | Fallon | 114/315 |
| 3,257,982 | 6/1966 | Meldrum | 114/315 |
| 3,416,478 | 12/1968 | Markham | 114/315 |
| 3,420,202 | 1/1969 | Oversmith | 114/315 |
| 3,442,240 | 5/1969 | Wild et al. | 114/315 |
| 3,503,356 | 3/1970 | Wilson | 114/315 |
| 3,548,771 | 12/1970 | Hastings | 114/315 |
| 3,550,386 | 12/1970 | Ballinger | 114/315 |
| 3,570,436 | 3/1971 | LeVasseur | 114/315 |
| 3,584,594 | 6/1971 | Poutout | 114/315 |
| 3,650,234 | 3/1972 | Goudy | 114/315 |
| 3,685,480 | 8/1972 | Peroni | 114/315 |
| 3,751,030 | 8/1973 | Winters | 114/315 |
| 3,768,431 | 10/1973 | Picken | 114/315 |
| 3,865,060 | 2/1975 | Bastide | 114/332 |
| 3,890,920 | 6/1975 | Buelk | 114/315 |
| 3,931,777 | 1/1976 | Colgan | 114/245 |
| 3,943,869 | 3/1976 | Frechette | 114/330 |
| 3,957,007 | 5/1976 | Thomas | 114/315 |
| 4,207,829 | 6/1980 | Meister et al. | 114/315 |
| 4,333,414 | 6/1982 | Hauz | 114/315 |
| 4,361,103 | 11/1982 | Willat | 114/245 |
| 4,577,583 | 3/1986 | Green, II | 114/330 |
| 4,624,207 | 11/1986 | King | 114/315 |
| 4,721,055 | 1/1988 | Pado | 114/330 |

*Primary Examiner*—Jesus D. Sotelo

*Attorney, Agent, or Firm*—Gifford, Groh, Sprinkle, Patmore and Anderson

[57] ABSTRACT

A submergible, two-passenger dive sled includes a foldable sled frame being adjustable in length, a break-away tow hook for interconnection within the tow line of a power boat, an adjustably foldable deflecting screen having a preferred position for maintaining the elevation of the sled at a preferred depth, forward most situated diver-controlled pivotable ailerons for adjusting and manipulating the axial stability and selected depth of the sled, and a break away tail piece feature for added safety. The dive sled is structured to have a positive bouyancy at its front end relative to its back end. The sled may be segmented into interconnected parts and may include selectively removable components for convenient storage and shipment. A number of electric lines are provided for provided power to lights optionally mounted on the sled and for allowing communication by an electric signal switch and an optional voice communicator. A series of diver-enclosing anti-shark shields may optionally be provided.

11 Claims, 3 Drawing Sheets

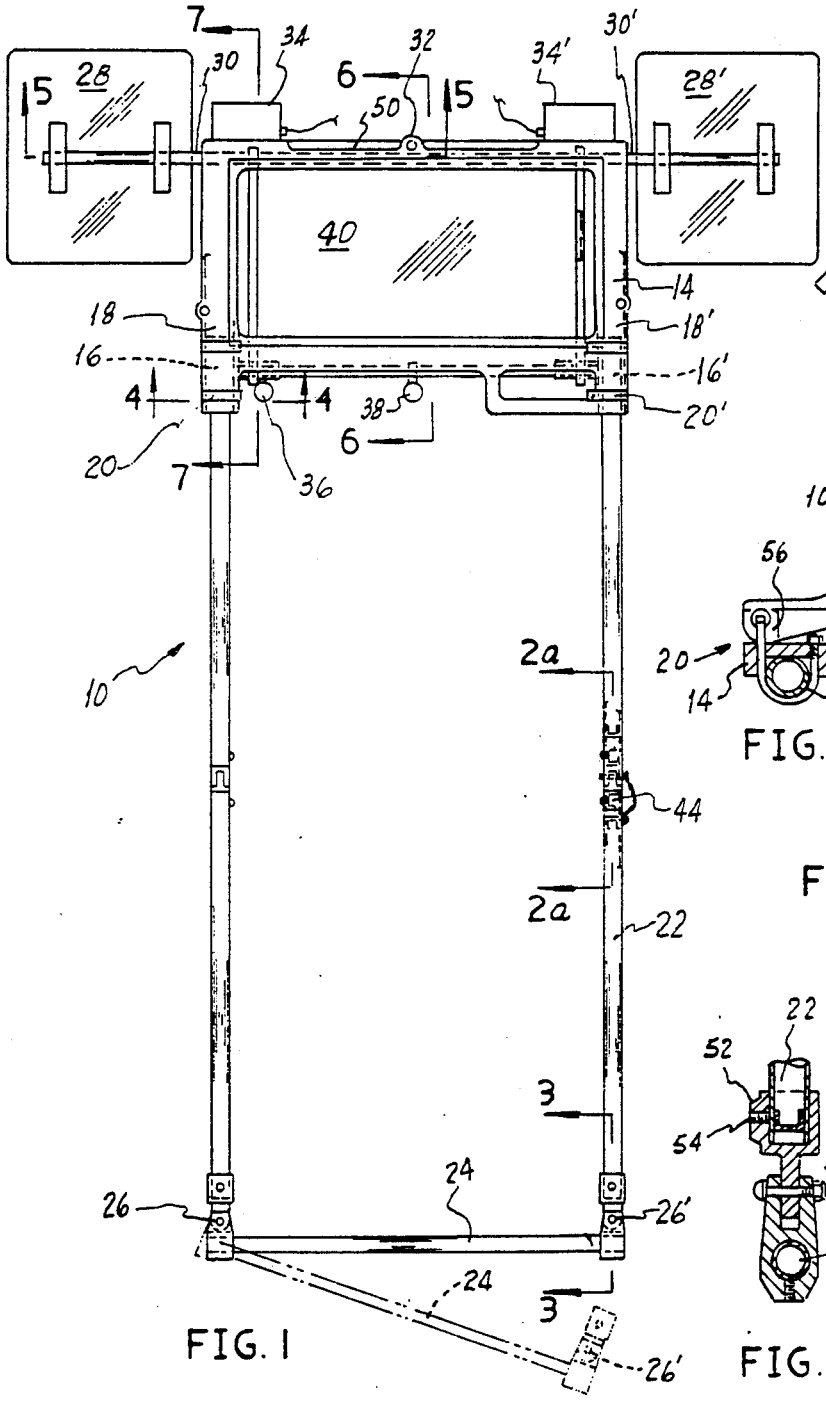
FIG. 1
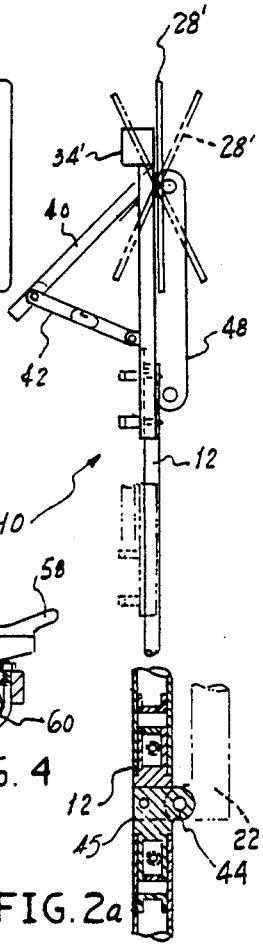
FIG. 2a
FIG. 2
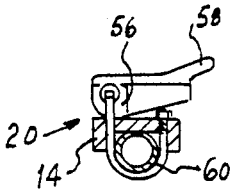
FIG. 4
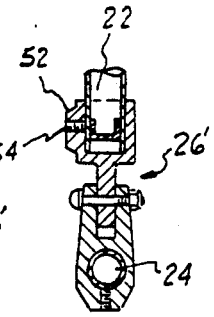
FIG. 3

74
96
76
70
90
98
64
9
92
94
47
46
9
90
86
65
90
88
66
68
88
34'
95
72
60
66

40
38
36
28'
55
59
30'
50
48
59
59
59
30
46

40
62
49
86
84
65
80
82
65
63
38
48
58
67

SUBMERGIBLE DIVING SLED

This is a continuation of copending application Ser. No. 07/410,287, filed on Sept. 21, 1989, now abandoned, which is a continuation-in-part of Ser. No. 238,583, filed on Aug. 31, 1988, now abandoned.

BACKGROUND OF THE INVENTION

1. Field of the Invention

The present invention relates generally to submergible diving sleds. More particularly, the present invention relates to a two-passenger diving sled that may be towed by a boat. The diving sled includes a pair of operator-adjusted ailerons mounted to the sled at its forward-most member for controlling the axial stability and depth of the diving sled.

2. Description of the Relevant Art

Since the first days of power boating, towing an individual behind the power boat became popular. It became very fashionable to tow skiers behind power boats and, similarly, inflated inner tubes also have been towed behind power boats as they were operated on a body of water. Accordingly, being towed by a power boat atop the water is popular and well known.

Somewhat relatedly, in approximately the last two decades, recreational scuba diving has become popular as a means of exploring and adventuring under the water. In regions having bodies of water, scuba diving, both in fresh and salt water, has become a very common and an almost every day sport.

To operate quickly under water, scuba divers have adapted to devices such as underwater scooters which comprise a body having a motor sealed therein and a propeller for propelling the unit and its accompanying diver through the water. Such devices are often expensive and are restricted to relatively slow speeds because of their small motors. Furthermore, recharging of such devices is constantly required.

In an early response to answering the need for a maneuverable, underwater vehicle, efforts were undertaken to produce workable underwater sleds.

One of the first such efforts is disclosed in U.S. Pat. No. 2,936,466, issued May 17, 1960, to Szymczyk et al. The sled disclosed in this reference is substantially composed of a flat, segmented board that doubles as an underwater sled and a surf board. The apparatus of Szymczyk includes a pair of adjustable fins mounted on the front half of the sled, but substantially behind the forward-most portion of the sled body.

A later attempt at providing an underwater sled is disclosed in U.S. Pat. No. 3,931,777 issued Jan. 13, 1976, to Colgan. The sled disclosed in this reference includes a sled body comprising a frame and including a pair of opposingly-situated, non-adjustable front-mounted sheets for, apparently, deflecting water. Mounted rearward of the sheets are a pair of rotatably adjustable plate-like members for controlling depth.

Although pursuing the right course, the apparatus of the discussed references fail to provide maximum control to the operator because of the placement of the ailerons. The known sleds further fail to maximize the utility of a water screen by, in the case of Szymczyk, not utilizing such a member at all and, in the case of Colgan, using fixed members. Furthermore, the known sleds offer no practical method of allowing for start-up from the bed of the water body within which the sled is operated in that, when stopped, the sled merely lies upon the floor. Start-up is hazardous because the floor is typically full of irregular objects and no practical "runway" is available.

Accordingly, known methods for allowing the diver maximum freedom of maneuverability while maintaining a practical working sled were previously unknown.

SUMMARY OF THE PRESENT INVENTION

The present invention discloses a submergible, two-passenger dive sled that overcomes all of the difficulties and limitations of known dive sleds. The sled includes a sled frame and a variety of elements attached thereto. The frame is composed of a salt-resistant material such as a polycarbonate, a nylon, or a stainless steel. The length of the frame may be adjusted by a slidable assembly. The frame may be partially folded for enhanced transportability.

Attached to the frame is a break-away tow hook that may be stressed to a certain pre-selected tension point whereupon it gives way, thereby providing a maximum amount of pressure to which the sled and its passengers may be exposed.

Rotatably mounted to either side of the frame at its forward-most member are a pair of ailerons. The axis of rotation of the ailerons is the same as the axis of the forward-most member, thereby vastly improving maneuverability over known sleds. Each aileron is fixed to its own shaft, and the two aileron shafts are coaxially situated. Each shaft is driven by a separate pulley assembly that is operated by a control stick.

The frame further has attached to its front portion a collapsible water deflecting screen. By such provision, water may be deflected for allowance of the sled and its operator to pass comfortably therethrough, thereby easing the impact of the water on the operator of the dive sled. In addition, the screen is set at a preferred angle whereby, at a two mile per hour speed of the towing boat, the angle of the shield acts to counteract the upward pull of the tow line, as a result, the sled remains at a constant depth with the ailerons being in their neutral positions (parallel with the frame).

To maximize the safety of the users, the frame includes a break-away rearward-most member whereupon if the member is caught upon an object, one side or the other breaks away and the member remains fastened to the sled by the pivotable action of the non-broken away side of the break away member.

The dive sled frame includes strategically-placed pockets of air to provide buoyancy to the front portion of the frame. This buoyancy allows the sled to obtain a vertical position on the waterbed when the sled is not being towed. This positioning provides the users with a preferred take-off position when towing begins thereby avoiding undesirable interaction with objects on the floor of the water body. In addition, this buoyancy provides a desirable feature when the sled is planing through the water.

For communicating with the tow boat, a communication system is provided in conjunction with the aileron control stick. This system may be operated by the operator of the dive sled to communicate with the tow boat while the sled is submerged and includes an electrical interconnection between the power boat and the dive sled. This interconnection includes a hand manipulable button maintained by the operator for contact with the tow boat. By utilizing a pre-arranged code system, the operator of the dive sled may thereby communicate with the operator or observer of the tow boat.

As an optional modification of the code system, a voice communicator system may be employed. Furthermore, Halogen-style lamps may also be added to the front of the sled to provide illumination of dark water.

In the event that the sled is used in a region that may be inhabited by sharks, anti-shark systems may be employed. One such system comprises a number of side-by-side half-ring members situated transversely with respect to the longitudinal axis of the sled within which the divers are positioned. Another option is a liquid detergent release system. (Liquid detergent is known to deter shark activity.)

The sled is designed for use by a pair of divers. Not only is this good practice according to the conventions of the buddy system of diving, but in some states statutes have been enacted that require that such sled use be done in pairs. Of course the operator and the passenger lie in a prone position thereby exposing minimal surface area and achieving least resistance to the water medium.

Other advantages and features of the present invention will become more apparent from the following detailed description when read in conjunction with the accompanying drawing.

BRIEF DESCRIPTION OF THE DRAWING

The present invention will be more fully understood by reference to the following detailed description of the preferred embodiments of the present invention when read in conjunction with the accompanying drawing in which like reference characters refer to like parts throughout the views, and in which:

FIG. 1 is a top plan view showing the major components of the dive sled according to the present invention;

FIG. 2 discloses a side view of the view of the embodiment shown in FIG. 1;

FIG. 2*a* discloses a detailed view of the frame hinging assembly of the present invention;

FIG. 3 is a detailed view of the rear portion of FIG. 2 illustrating the break-away component construction of the rearward most member of the sled of the present invention;

FIG. 4 is a detailed view taken along line 4—4 of FIG. 1 of the toggle clamp mechanism employed for allowing adjustment of the length of the sled frame;

DETAILED DESCRIPTION OF THE PREFERRED EMBODIMENT OF THE PRESENT INVENTION

Figures 5, 6, 7, 8, 9:
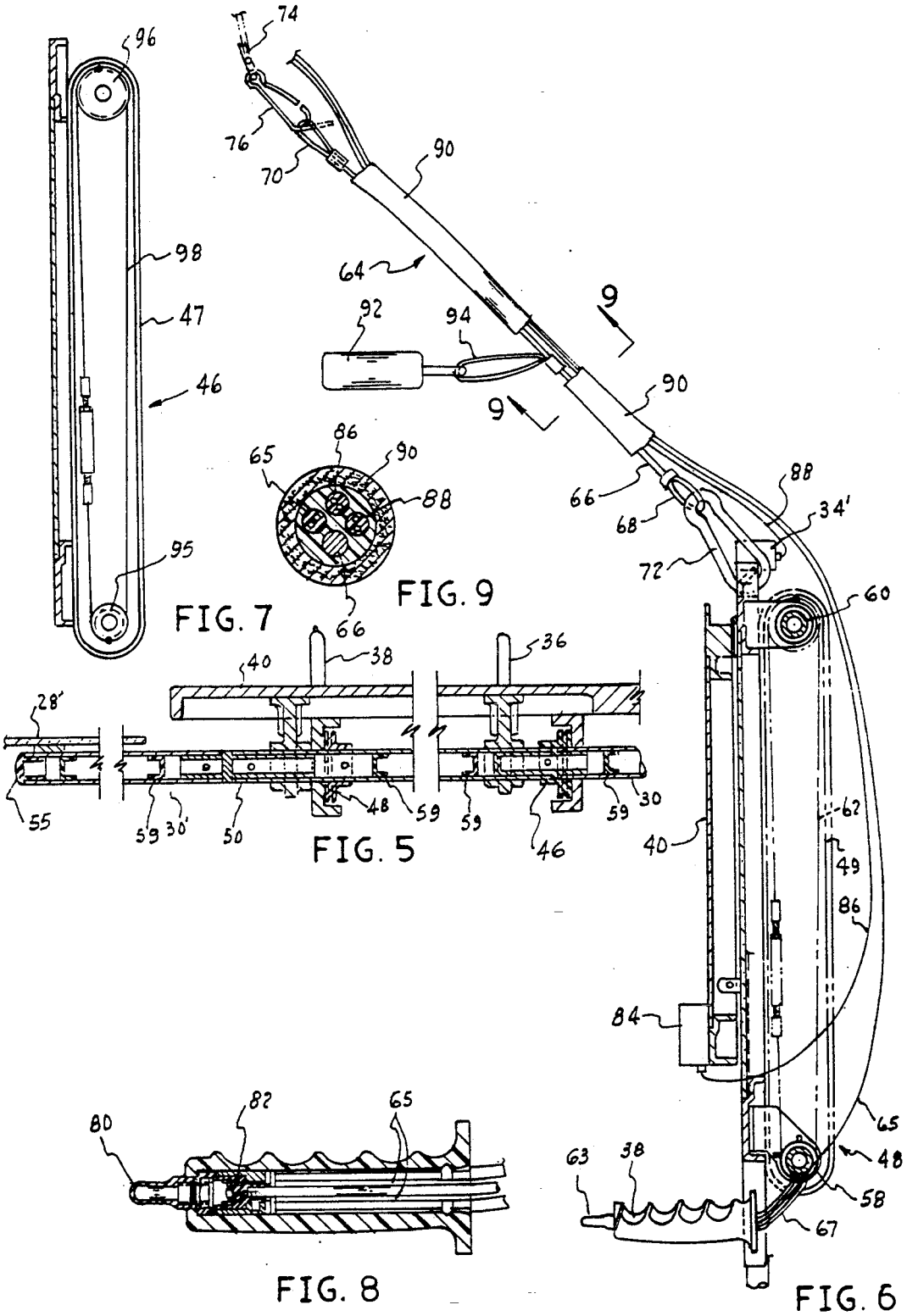
FIG. 5 is a front detailed view in section of the sled frame illustrating the details of the pulley system, the aileron shafts, and the water shield.
FIG. 6 is a view taken along line 6—6 of FIG. 1 illustrating details of one of two pulley assemblies, its associated control lever and the tow and electric lines.
FIG. 7 is a view taken along line 7—7 of FIG. 1 detailing the other of two pulley systems.
FIG. 8 is a detailed sectional view of the control lever.
FIG. 9 is a cross-sectional view of the cable taken along line 9—9 of FIG. 1.

FIGS. 1–12 show preferred embodiments of the present invention. While the configurations according to the illustrated embodiments are preferred, it is envisioned that alternate configurations of the present invention may be made without deviating from the invention as portrayed. The preferred embodiments are discussed hereafter.

With reference to FIG. 1, there is shown a top plan view of a submergible dive sled according to the present invention, generally indicated as 10. For the sake of enabling adjustment of the length of the sled 10 to fit a particular pair of divers, the sled 10 includes an intermediate body portion 12 having telescopingly attached thereto a front portion 14. The intermediate body portion 12 includes at its front end a pair of slidable portions 16, 16′ that are telescopingly slidable within a pair of receiving portions 18, 18′. The portions 16, 16′ are locked into place by a pair of locking assemblies 20, 20′ described in detail below with respect to FIG. 4.

To maximize transportability of the sled 10, a rear portion 22 is pivotably included as is discussed below with respect to FIGS. 2 and 2*a*. The sled riders (not shown) rest the dorsal sides of their feet, approximately at their arches, upon a rear releasable bar 24. The bar 24 may be broken away as illustrated in broken lines if the sled 10 should intercept a rock formation or other fixed object located on the floor of the particular water body through which the divers are riding. The bar 24 is releasably attached to the rear portion 22 by means of a pair of release assemblies 26, 26′. As illustrated, in the event of release, only one of the assemblies 26, 26′ is caused to release, thereby leaving the bar 24 substantially attached to the sled 10 thus obviating the need for later recovery of the bar 24.

The front portion 14 of the sled 10 includes a variety of fittings thereupon. Of these fittings the most critical are the first aileron 28 and the second aileron 28′. The ailerons 28, 28′ are pivotably provided so the operator of the sled 10 (not shown) may control the underwater movement of the sled 10 to a limited extent. The first aileron 28 is attached to the sled 10 by a first shaft 30. The second aileron 28′ is attached to the sled 10 by a second shaft 30′. The construction of the ailerons 28, 28′ and the shafts 30, 30′ is described below in detail with respect to FIG. 5.

At the front of the front portion 14 is fitted a tow hook 32. A pair of headlights 34, 34′ are optionally provided to maximize the utility of the sled 10 for use during night diving or to assist in illuminating cloudy or murky water. Preferably the lights 34, 34′ are of the halogen type to maximize illumination.

To control the sled 10 while submerged and being towed, control devices are provided which comprise a first aileron control stick 36 and a second aileron control stick 38. The first stick 36 controls the first aileron 28, whereas the second stick 38 controls the second aileron 28′.

Further provided on the front portion 14 of the sled 10 is a collapsible, substantially planar, water-deflecting screen 40. This is described below with respect to FIG. 2.

With reference to FIG. 2, a side view of the sled 10 is illustrated whereby the details of the component parts thereof may be more fully understood.

Specifically, FIG. 2 offers detail as to the collapsibility of the water-deflecting screen 40 and the movement of the second aileron 28' (the first aileron 28 operates in substantially the same manner).

With reference to the water-deflecting screen 40, the screen 40 is hingedly attached to the front body portion 14 by a pair of hinges 42. The hinges 42 are strengthened to provide adequate reinforcement of the screen 40 whereby the impact of rushing water is withstood. The front of the screen 40 is also hingedly attached to the front of the front portion 14 by a hinged assembly (not shown).

The angle illustrated in FIG. 2 is the suggested angle to be maintained by the screen 40. At this preferred angle the sled 10 will remain at a selected depth if the tow boat remains at a constant speed of two miles per hour. The illustrated angle of the screen 40 compensates for the tendency of the sled 10 to drive upward toward the surface as it is being towed. The preferred setting is at forty-five degrees.

The collapsibility of the sled 10 may be fully understood by reference to FIG. 2*a* which reveals, in close-up detail a body hinge assembly 44. The hinge assembly 44 includes a locking pin and chain assembly 45 as illustrated in FIG. 1. The assembly 45 allows the rear portion 22 to be locked into either its extended position as illustrated or into its collapsed position for transporting depending on the placement of the locking pin.

With reference back to FIG. 2 and the illustrated second aileron 28', the broken lines illustrate the upward-most and downward-most positions of the second aileron 28' as selectively positioned by the operator. Rotational stops (not visible from the illustrated views) are included to prevent the ailerons 28, 28' from exceeding forty-five degrees of upward or downward movement. These restrictions prevent the ailerons 28, 28' from becoming overly stressed during operation.

A pair of pulley assemblies 46, 48 are utilized to interconnect the control sticks 36, 38, respectively, with the ailerons 28, 28'. In FIG. 2 only pulley assembly 48 is visible.

The forward-most placement of the ailerons 28, 28' allows for the rotational axis of the shafts 30, 30' to operate along the axis of a front member 50 of the front portion 14. The member 50 may be clearly seen in FIG. 1. This forward-most placement of the ailerons 28, 28' results in approximately three times the maneuverability of the sled 10 over known sleds that utilize more rearward-mounted ailerons or fins. This construction therefor provides a significant advantage of critical maneuverability over other sleds.

With reference to FIG. 3, a detailed view of the release assembly 26' is illustrated. The assembly 26' includes a releasable attachment portion 52 having a set screw 54 mounted therein. Once caused to release, the attachment portion 52 may be refitted with little inconvenience.

With reference to FIG. 4, a close up detailed view of the locking assembly 20 is illustrated. The assembly 20 is cam-activated and comprises a cam body 56 having fixed thereto a cam lever 58. The cam body 56, when tightened by action on the cam lever 58, brings a U-bolt 60 to bear upon a segment of the intermediate portion 12. The intermediate portion 12 is thereby pressed against the underside of the front portion 14.

With reference to FIG. 5, a front view of the sled 10 is partially shown in segment. This view highlights, in cut-away style, the inner workings of the front member 50 which includes therein the first aileron shaft 30 and the second aileron shaft 30'. The first aileron shaft 30 is controllable by the first control stick 36 which operates thereupon by a first pulley assembly 46. The second aileron shaft 30' is controllable by the second control stick 38 which operates thereupon by a second pulley assembly 48. The first and second control sticks 36, 38 respectively may be used by the operator to selectively execute rolls, turns, lifts and drops depending upon how the operator selects to manipulate each with respect to the other and to the sled 10.

Because a horizontal take-off while the sled 10 is to be drawn off from a stopped position underwater is not practical or desirable in that the bed of the body of water wherein the sled 10 is being used typically would not have a smooth floor, a structure is included in the present invention to provide a positive buoyancy to the upper portion 14 relative to the lower portion 22. By capturing standing air within the substantially hollow interior cavities of the shafts 30, 30' by the fitting into the ends thereof a pair of securing plugs here illustrated by an end plug 55. The plugs 55 may be selectively fitted about the frame members of the sled 10 where desired to selectively provide the necessary buoyancy and, as an important added feature, to keep water (especially salt water) from entering into the frame members. The function of the plugs 55 is enhanced by a number of internal plugs 59 strategically situated to selectively keep air in and water out.

Referring to FIG. 6, a partial side view of the front portion 14 of the sled 10 is thereshown. This view illustrates in detail the component elements of the second pulley assembly 48 enclosed by a second pulley assembly cover 49. The pulley assembly 48 includes a small drive pulley 58 and a relatively large take-up pulley 60. Of course, the ratios of the pulleys 58, 60 may be adjusted or altered as desired to maximize or minimize the motions of the operator.

Interconnecting the pulleys 58, 60 is a drive cable 62 shown in broken lines. The stick 38 is coupled to the small drive pulley 58 so that movement of the stick 38 rotatably pivots the pulley 58. The small drive pulley 58 and the large take-up pulley 60 are rotatably connected by the drive cable 62. By manipulation of the stick 38 forward or backward, the pulley 58 is consequently rotated forward or backward, thus drawing the cable in one direction or the other which rotates the pulley 60 forward or backward resulting in alteration of the angle of the aileron 28' (not shown in this figure).

Naturally, communication with the towing boat is desirable, but not conventionally workable by conventional audible or visible methods. To answer this need, a diver-operated controlled communication system is provided which includes a momentary toggle switch element 63 provided integrally with the second aileron control stick 38 and a signal communication line 65. By establishing a set of signals prior to riding the sled 10, the sled operating diver may signal those in the boat in case of emergency or with instructions including "slow down", "speed up", "stop", and the like.

With reference accordingly to FIG. 8, a detailed view of the internal elements of the control stick 38 is shown. The momentary toggle switch element 63 includes a boot 80 and contact assembly 82 interconnecting the signal communication line 65.

The momentary toggle switch element 63 is constructed so as to withstand the possible invasion of water, sand or mud to pressures found deep in the water such as to five hundred feet below sea level. The communication line 65 is protected by a wire holder 67 to minimize the risk of the line 65 being entangled.

To enhance transportability, both the first and second control sticks 36, 38 may be removed for shipping or storing.

With reference back to FIG. 6, where more sophisticated communications between the divers and the tow boat are desired, an optional voice communications system may be provided comprising a communications box 84 and a voice communications line 86. The communications box 84 is preferably situated atop the screen 40 where it is relatively conveniently located for use by either diver.

The view of FIG. 6 discloses a side view of the light 34'. The lights 34, 34' receive power from the boat by the light power line 88.

A cable assembly 64 is included to interconnect the sled 10 with the tow boat (not shown). A heavy tow cable 66 is provided as the main connection between the sled 10 and the boat. The cable has a first connecting loop 68 and a second connecting loop 70. The first loop 68 is connected to the front portion 14 of the sled 10 at the tow hook 32 by a releasable link 72. The second loop 70 is connected to a line 74 from the boat by a break away clip 76. The clip 76 is constructed whereby it releases its load should tension exerted thereupon by the sled 10 exceed a preselected amount. This construction provides an added measure of safety to the divers and the sled 10.

As may be seen by reference to FIG. 9, the cable 66 and the power lines 65, 86, 88 are encased in an outer cable assembly wrap 90. The wrap 90 may be composed of a plastic, a nylon, or rope.

With reference again back to FIG. 6, to provide a necessary element of buoyancy to the cable assembly 64 and thereby prevent sagging, a floatation device 92 (such as a boat bumper or a float) is fitted to the assembly 64 by a floatation device connecting line 94.

With reference to FIG. 7, a side view of the first pulley assembly 46 is illustrated. The pulley assembly 46 includes a small pulley 95, a large pulley 96 and a pulley drive line 98. The assembly 46 operates upon the first aileron 28 by the first control stick 36 in the same manner as described above in relation to FIG. 6 with respect to the operation of the second pulley assembly 48. The assembly 46 is housed within a first pulley assembly cover 47.

Figure 10:
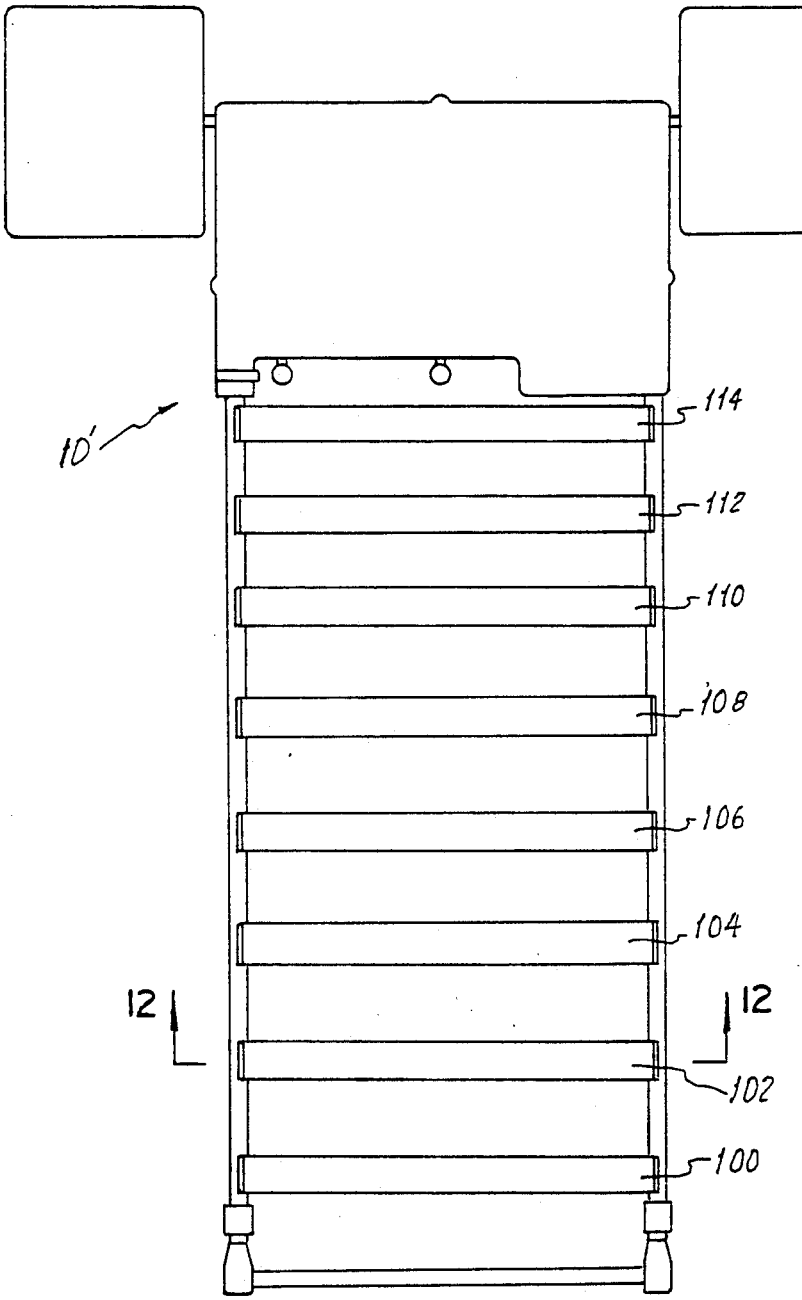
FIG. 10 is a plan view of an alternate embodiment of the present invention.
Figure 11:
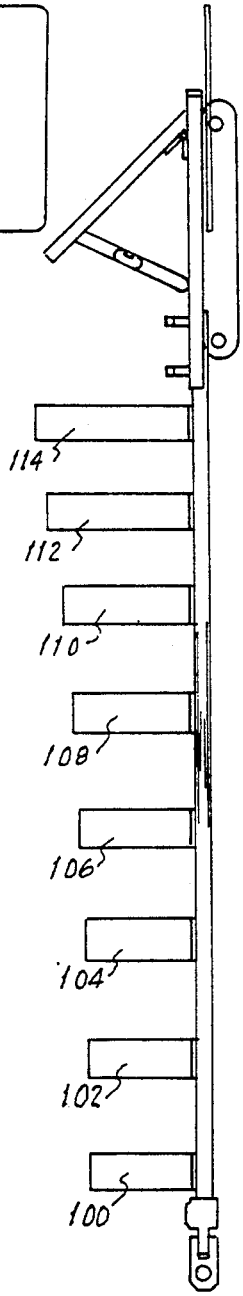
FIG. 11 is a side view of the embodiment of FIG. 10.

It is naturally anticipated that dive sled according to the present invention will be utilized in an ocean environment. Accordingly, the divers utilizing an alternated embodiment of the sled of the present invention, indicated as a sled 10', may happen upon one or more sharks while adventuring through the water depths. Anticipating this potentially dangerous encounter, the sled 10' may have included therewith an anti-shark structure as illustrated in FIG. 10.

Figure 12:
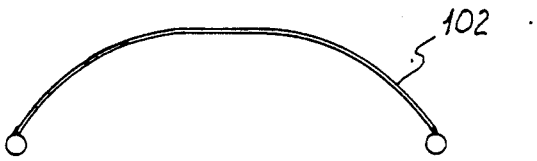
FIG. 12 is a sectional view of the embodiment of FIG. 10 taken along lines 12—12 thereof.

According to this embodiment, the sled 10' is constructed substantially as described above, but has added thereto a number of side-by-side positioned half-ring members 100, 102, 104, 106, 108, 110, 112, 114 with each member being of increasing dimension from the smallest sized member 102 to the largest size of 114. This construction suggests a tapered appearance that may be viewed clearly by reference to FIG. 11 and provides a comfortable interior fit to the divers. The members 100, 102, 104, 106, 108, 110, 112, 114 are preferably composed of a reinforced polymerized material or a natural rubber. Each of the members 100, 102, 104, 106, 108, 110, 112, 114 is provided in an arcuate shape as illustrated in FIG. 12 which is a sectional view taken along line 12—12 of FIG. 10.

Having set forth the present invention and what is considered to be the best embodiments thereof, it will be understood that changes may be made from the specific embodiments set forth without departing from the spirit of the invention or exceeding the scope thereof as defined in the following claims.

I claim:

1. A submergible diving sled towable by a power boat comprising:

a submergible sled body upon which two persons may be fitted, said body having two sides, a longitudinal axis, and a frontward-most member substantially interconnecting said two sides and being situated transversely relative to said longitudinal axis;

means for attaching said body to said power boat;

said sled body including a front body portion, an intermediate body portion, and a rear body portion, said front body portion being telescopingly attached to said intermediate body portion and said rear body portion being hingedly attached to said intermediate body portion;

said front body portion including a first side-mounted aileron and a second side-mounted aileron, a first aileron shaft attached to said first aileron, a second aileron shaft attached to said second aileron, said shafts being coaxial.

2. The submergible diving sled of claim 1 wherein said rear body portion includes a transversely mounted tail segment, said segment being reattachably releasable when a preselected amount of force is applied thereto.

3. The submergible diving sled of claim 1 wherein said front body portion includes a plurality of frame segments.

4. The submergible diving sled of claim 3 wherein select ones of said plurality of frame segments include therein a trapped gas whereby a positive buoyancy is provided with respect to said front portion relative to said intermediate and rear portions.

5. The submergible diving sled of claim 4 wherein said gas is trapped by a plurality of plugs internally fitted within said select ones of said plurality of frame segments.

6. The submergible diving sled of claim 1 wherein each of said portions of said sled body include a top side and a bottom side, said body further including a substantially planar water-deflecting screen being collapsibly mounted on said to side of said front body portion.

7. The submergible diving sled of claim 1 further comprising means for communicating with said power boat.

8. The submergible diving sled of claim 7 wherein said means for communicating includes:

An electrical signal switch portion integral with said second aileron control stick; and circuitry interconnecting said switch portion and said power boat;

said control stick including means for water- and pressure-proofing said switch portion.

9. The submergible diving sled of claim 7 wherein said means for communicating includes:

A voice communication portion; and circuitry interconnecting said communication portion and said power boat.

10. The submergible sled of claim 1 wherein said sled body further includes means for lighting attached thereto.

11. The submergible sled of claim 1 further including a first pulley assembly for driving said first aileron and a second pulley assembly for driving said second aileron.

* * * * *